United States Patent [19]

Marquez et al.

[11] Patent Number: 5,015,535

[45] Date of Patent: May 14, 1991

[54] ARTICLE FORMED FROM A LOW CARBON IRON ALLOY HAVING A CORROSION RESISTANT DIFFUSION COATING THEREON

[75] Inventors: Edmundo M. Marquez, Caracas, Venezuela; Jean-Francois Nowak, Etienne, France; Antonio Robles, Miranda, Venezuela

[73] Assignee: Intevep, S.A., Caracas, Venezuela

[21] Appl. No.: 520,721

[22] Filed: May 9, 1990

Related U.S. Application Data

[60] Division of Ser. No. 349,951, May 8, 1989, Pat. No. 4,929,473, which is a continuation of Ser. No. 79,693, Jul. 30, 1987, abandoned.

[51] Int. Cl.[5] ..... B32B 15/18

[52] U.S. Cl. ..... 428/610; 428/653; 428/941

[58] Field of Search ..... 428/610, 653, 941

[56] References Cited

U.S. PATENT DOCUMENTS

| | | | |
|---|---|---|---|
| 3,061,462 | 10/1962 | Samuel | 428/591 |
| 3,096,205 | 7/1963 | De Guisto | 428/653 |
| 3,403,988 | 10/1968 | Carter | 428/610 |
| 3,467,545 | 9/1969 | Carter | 428/653 |
| 3,762,884 | 10/1973 | Grisaffe et al. | 428/610 |
| 3,779,719 | 12/1973 | Clark et al. | 428/941 |
| 3,907,611 | 9/1975 | Sasame et al. | 428/610 |
| 4,394,422 | 7/1983 | Van Thyne et al. | 428/610 |
| 4,467,016 | 8/1984 | Baldi | 428/667 |

FOREIGN PATENT DOCUMENTS

| | | | |
|---|---|---|---|
| 688675 | 6/1904 | Canada | 427/253 |
| 55-82772 | 6/1980 | Japan | 428/651 |
| 797326 | 7/1958 | United Kingdom | 427/253 |

*Primary Examiner*—John J. Zimmerman
*Attorney, Agent, or Firm*—Bachman & LaPointe

[57] ABSTRACT

The present invention relates to a ferrous article suitable for use in devices for burning heavy and extra heavy petroleum fuels and a process for forming such an article. The article has a matrix formed from a low carbon steel and a corrosion resistant chromium-aluminum diffusion coating on at least one surface. The coating is formed by subjecting the matrix to successive aluminization and chromization pack cementation treatments.

8 Claims, 5 Drawing Sheets

ARTICLE FORMED FROM A LOW CARBON IRON ALLOY HAVING A CORROSION RESISTANT DIFFUSION COATING THEREON

This is a division of application Ser. No. 349,951, filed May 8, 1989, now U.S. Pat. No. 4,929,473, which is a continuation of Ser. No. 079,693, filed 07/30/87, now abandoned.

BACKGROUND OF THE INVENTION

The present invention relates to a process for applying a diffusion coating containing chromium and aluminum to a low carbon content steel article for improving its resistance to high temperature corrosion caused by combustion ashes rich in vanadium, sulfur and sodium. Low carbon steel articles with the aforementioned diffusion coating may be used in boilers and other petroleum burning devices.

There exists in the prior art several steels and alloys recommended for use in applications involving corrosive environments at high temperature conditions. There also exists several suggested metallic coatings for the protection of iron base materials. These suggested alloys and/or coatings are generally effective in applications involving oxygen and/or sulfur containing atmospheres and/or ashes containing a low concentration of vanadium. Most of these alloys and coatings are ineffective in situations involving highly corrosive ashes at high temperatures produced by the combustion of heavy and extra-heavy oil residuals having a high content of vanadium, sulfur and sodium in the ranges of from 400–1200 ppm, 3–6% by weight and 0.05–0.6 lb/bbl, respectively. In part this is because some of the coatings exhibit a microstructure with large grains oriented perpendicularly to the matrix coating interface. This type of crystallization, termed basaltic, compromises the good mechanical properties of the coated steel.

Some of these steels, alloys and coatings recommended for high temperature corrosion service were placed in contact with a salt mixture consisting of 85 wt.% $V_2O_5$ and 15 wt.% $Na_2SO_4$ and evaluated in a gaseous environment consisting of 2400 ppm $SO_2$, 100 ppm $SO_3$, 1% $O_2$, and the balance nitrogen at a temperature of 700° C. for 100 hours. These materials generally demonstrated a low chemical resistance. FIG. 1 shows typical weight loss results due to corrosion for these materials.

There are many techniques for forming diffusion coatings on metals. One such technique is known as pack cementation. Most pack cementation techniques have one thing in common—direct contact between the reactive mixture and the articles to be treated. U.S. Pat. Nos. 2,816,048 to Galmiche, 3,900,613 and 4,096,296 both to Galmiche et al., 4,141,760 to Baldi, 4,276,088 to Zaets and 4,293,388 to Rose et al. illustrates some of the pack cementation techniques known in the art for forming diffusion coatings.

The Galmiche '048 patent relates to a process for forming a chromium alloy on a body having as a principal component a metal selected from the group consisting of iron, nickel and cobalt. The process broadly comprises heating a mixture containing chromium and an inorganic fluorine compound to form chromium fluoride vapors and bringing the vapors in the presence of hydrogen into contact with the metal body at a temperature above 600° C. while maintaining the metal body out of contact with the cementatious mixture. In an alternative embodiment, the mixture also contains a material selected from the group consisting of alumina, aluminum, zirconia, zirconium and silicon.

The Galmiche et al. '613 patent relates to a method for forming a surface diffusion alloy by applying at least one application metal selected from the group consisting of chromium, titanium, tantalum, vanadium, boron, aluminum, zirconium, and alloys thereof to the inner wall of a hollow metallic part. The method comprises introducing a cement comprising a powder of the at least one application metal, an inert diluent, a halogen or halogenated compound, and a surface active agent in an amount sufficient to confer thixotropic properties on the cement in the cavity of the hollow part, subjecting the cement within the cavity to vibration to temporarily liquefy it, heat the cement to generate vapors of the application metal to form a surface diffusion alloy of the application metal and the metallic part at the inner wall, and subsequently removing the cement using an aqueous or alcohol acid solution.

The Galmiche et al. '296 patent relates to a process for forming a surface diffusion alloy using one or two addition metals on a metal article. The process comprises at least partly covering the article with a metallic felt coated with a film of stable refractory oxide such as chromium oxide, submerging the article and the felt in a reagent containing a mixture of a first powder of the addition metal or alloy and a second powder of an inert diluent, and thereafter subjecting the reagent and the article to a thermal treatment in a halogen-hydrogen atmosphere at a temperature between 750° and 1200° C. The process is intended to improve the performance of hollow turbine blades which are subjected to hot corrosive gases.

The Baldi patent relates to the coating of metals such as plain carbon steel to improve their corrosion resistance. The coating may be formed by immersing the articles to be treated in an aluminum-alumina powder pack, heating the immersed articles to form an aluminized surface, spray an aqueous dispersion containing leafing aluminum on the article, baking the sprayed articles, forming a spray coating of colloidal alumina, and finally applying a top spray coating.

The Zaets et al. patent relates to a composition for forming a diffusion coating on ferrous metals. The composition contains 70 to 82% titanium, 14.5 to 20% alumina, 2 to 5% ammonium halide and 1 to 2% graphite. The coating is intended to protect work pieces subjected to highly concentrated salt solutions and chloride containing media such as pump and valve casings.

The Rose et al. patent relates to powder-type diffusion coating compositions for use in a codeposition process involving the formation of a diffusion coating of chromium and aluminum on high nickel and high cobalt superalloys. The compositions are characterized by use of the intermetallic compound $Co_2Al_9$. The composition is particularly useful on superalloys containing about 16% chromium or less.

It is believed that these particular diffusion coating techniques are not particularly well suited to solving corrosion problems arising from burning petroleum fuels, especially those containing a high concentration of vanadium, sulfur and sodium. Pipes and pipe supports for boilers and other petroleum burning devices are generally formed from steel and often encounter aggressive environments containing such low melting salts such as $V_2O_5$, $Na_2SO_4$, vanadium complexes of sodium and sulfur ferrous alkalis under high temperature conditions. Consequently, these articles need to be formed from a material such as steel capable of withstanding these aggressive environments.

Accordingly, it is an object of the present invention to provide a process for improving the high temperature corrosion resistance of a ferrous article.

It is a further object of the present invention to provide a process as above capable of forming a high temperature corrosion resistant chromium-aluminum diffusion coating on a ferrous article.

It is yet a further object of the present invention to provide a ferrous article suitable for use in devices for burning heavy and extra heavy petroleum fuels.

These and other objects and advantages will become apparent from the following description and drawings

SUMMARY OF THE INVENTION

The present invention relates to a ferrous article suitable for use in devices for burning heavy and extra heavy petroleum fuels and a process for forming such an article. The article comprises an element such as a pipe or pipe support formed from a low carbon steel matrix and a chromium-aluminum diffusion coating on at least one surface of the steel. The carbon content of the steel, less than about 0.25% carbon, and preferably less than about 0.15% carbon, is critical because of its retarding effect on diffusion of the protective elements into the steel. Carbon, if present in a high content, tends to form carbides and limit the diffusion depth.

The diffusion coating process of the present invention is essentially a two-step process. In the first step, an aluminum diffusion coating is formed using a pack cementation technique. The technique comprises preparing a powder consisting essentially of from about 0.5% to about 32% aluminum, from about 1.5% to about 5% $NH_4Cl$ and the balance $Al_2O_3$, immersing the steel article to be treated in the powder, heating the article and the powder to a temperature in the range of from about 750° C. to about 1150° C. for less than about 2 hours in a reducing environment. The composition of the powder used in the first step permits formation of a coating of the solid solution kind. The second step of the coating process comprises a chromization treatment. In this treatment, a powder having a composition consisting essentially of from about 50% to about 95% chromium, from about 1.5% to about 5% $NH_4Cl$ and the balance $Al_2O_3$ is used. The steel article with the aluminum diffusion coating is placed in contact with the powder and heated to a temperature greater than about 900° C. for up to 6 hours in a reducing environment.

The coating produced by this process has a thickness of from about 50 to about 200 microns, a microhardness similar to that of the underlying steel matrix, and both aluminum and chromium as constituents. The presence of aluminum in the diffusion coating provides high chemical resistance in $SO_2/O_2/SO_3$ atmospheres at temperatures in the range of from about 500° C. to about 1000° C. The presence of chromium in the coating, especially in concentrations up to 90% in its external zone, provides high chemical resistance to melt salts containing high vanadium, sulfur and sodium concentrates. Other characteristics of the diffusion coating are its substantially uniform thickness, the substantial absence of porosity, and its solid solution nature.

DETAILED DESCRIPTION OF THE INVENTION

Figure 1:
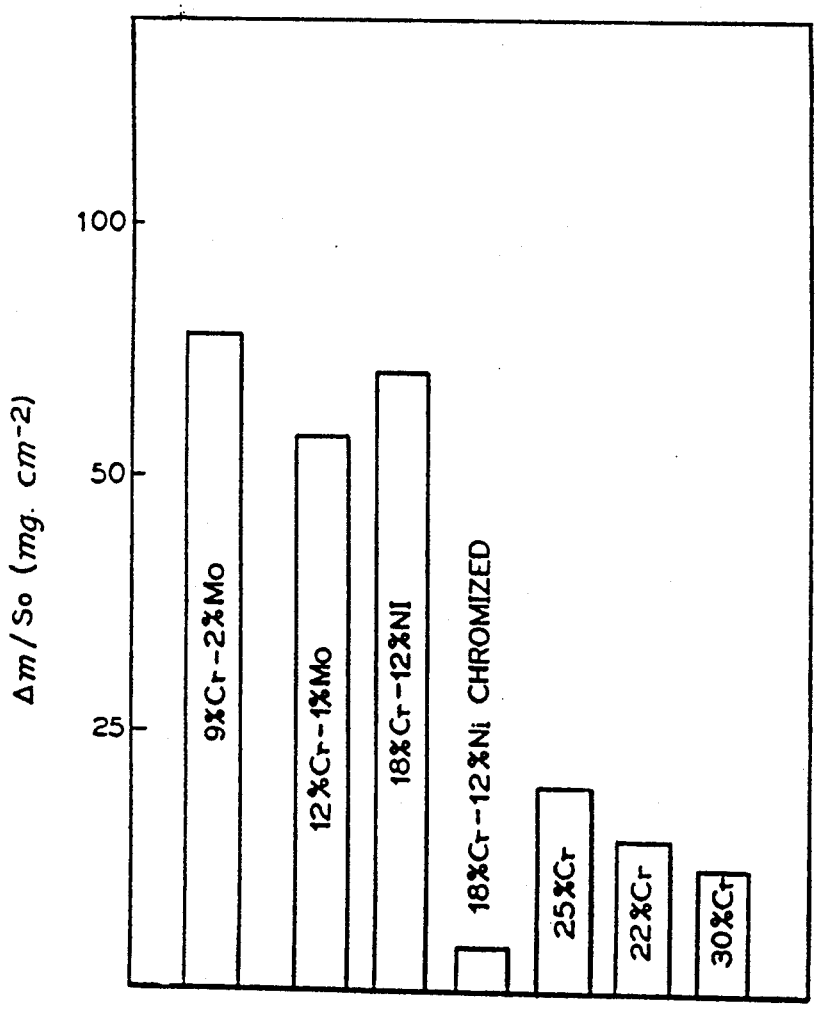
FIG. 1 is a graph illustrating the weight loss of certain steels, alloys and a metallic coated stainless steel due to high temperature corrosion in a vanadium, sulfur and sodium environment.

As previously discussed, steels because of their mechanical properties under high temperature service conditions are often used for boiler and furnace components. During service, these steel components encounter aggressive corrosive environments resulting from the combustion of petroleum fuels containing high concentrations of vanadium, sulfur and sodium. These environments often contain low melting salts such as $V_2O_5$, $Na_2SO_4$, vanadium complexes of sodium and sulfur ferrous alkalis. It thus becomes necessary to provide these steel components with a coating which provides a high degree of corrosion resistance in such environments.

The present invention relates to a process for forming a corrosion resistant, chromium-aluminum diffusion coating on articles formed from a low carbon steel, a steel containing less than 0.25% carbon, preferably less than about 0.15% carbon. Typical low carbon steels include a 9% Cr—2% Mo—0.08% C steel and a 2¼% Cr—1% Mo—0.1% C steel. In terms of forming the desired diffusion coating, the carbon content of the steel is critical. This is because of the retarding effect of carbon on the diffusion of the protective elements, aluminum and chromium, into the steel during the process. Carbon, if present in high concentrations, tends to form undesirable carbides such as chromium carbides and limits the diffusion depth.

The diffusion coating forming process is a two step process. The first step is an aluminization treatment for forming an aluminum diffusion coating on at least one surface of the steel component. The second step is a chromization treatment for converting the aluminum diffusion coating into a chromium-aluminum diffusion coating. The initial aluminization treatment uses a pack cementation technique to form the aluminum diffusion coating. The kinetics of aluminization treatments are generally very quick. As a result, the kinetics Promote the formation of very hard, fragile intermetallic compounds on the surface of a steel article being treated. The present invention overcomes this problem by using a powder which allows the formation of a coating which metallurgically is of the solid solution type. The powder consists essentially of from about 0.5% to about 32%, preferably from about 5% to about 28% aluminum, from about 1.5% to about 5% aluminum chloride and the balance essentially alumina.

In order to form a single phase, substantially uniform metal coating on the article, it is desirable that the aluminization treatment be carried out at a temperature in the range of from about 700° C. to about 1150° C., preferably at a temperature in the range of from about 900° C. to about 1100° C. Higher temperatures are undesirable because they can cause the precipitation of an unwanted intermetallic phase. Lower temperatures are undesirable because they can delay the aluminum diffusion. The aluminization hear treatment is preferably carried out in a reducing environment such as a hydrogen atmosphere for time less than about two hours.

The diffusion coating is formed on the steel component by placing the surface or surfaces of the steel component to be coated in contact with the powder and applying the above mentioned heat treatment. The steel article and the powder may be placed in any suitable container such as a high porosity iron box previously treated with the powder or the alumina crucibles prior to commencing the heat treatment.

After the aluminization treatment has been completed and the article has been allowed to cool, the chromization treatment is applied. In accordance with the present invention, the chromization treatment is always applied after the aluminization treatment.

The chromization treatment of the present invention is also a pack cementation technique using a high chromium content powder. Such a powder is needed because chromization treatments have very slow kinetics. When used with steels to obtain the desired corrosion resistant diffusion coating, a powder having a composition consisting essentially of from about 50% to about 95%, preferably from about 60% to about 80%, chromium from about 1.5% to about 5% aluminum chloride and the balance essentially alumina is used.

As before, the steel article to be treated and the powder are placed in a container and in contact with each other. If only one surface is to be coated then the other surfaces of the steel article are kept out of contact with the powder in any desired manner. The article and the powder are then subjected to a heat treatment at a temperature greater than about 900° C., preferably at a temperature in the range of from about 900° C. to about 1100° C., because of the low kinetics. The heat treatment is carried out for at least about three hours and up to about six hours to allow for good chromium diffusion. This treatment is also carried out in a reducing environment such as a hydrogen or argon atmosphere.

Figure 2:
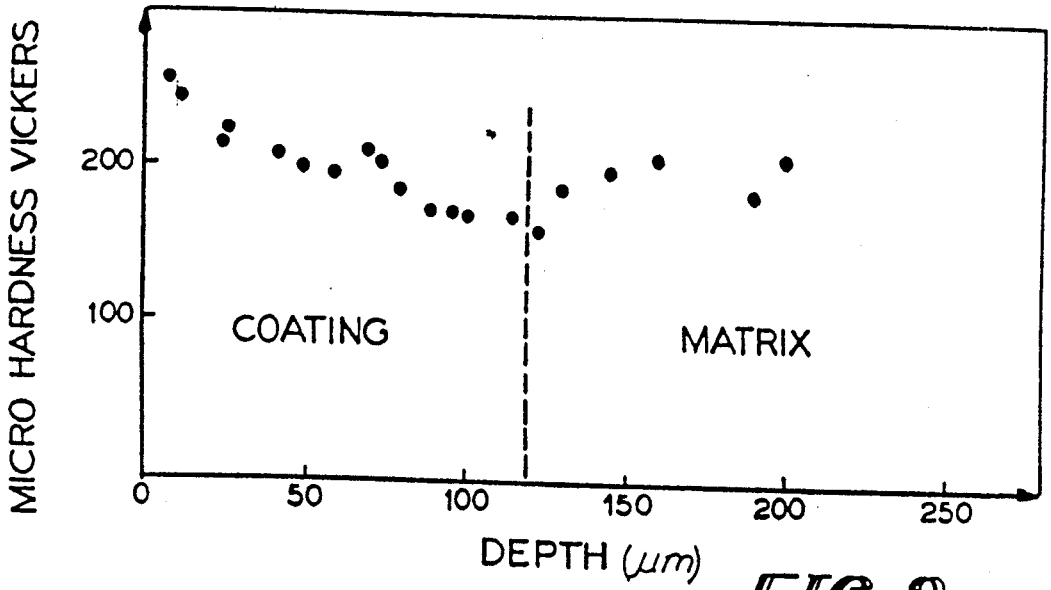
FIG. 2 illustrates the microhardness values of a coating formed in accordance with the present invention on a low carbon steel.

It has been found that by performing the above process, it is possible to obtain a coating having a thickness in the range of from about 50 microns to about 200 microns. Thicknesses higher than 200 microns generally have poor mechanical properties while thicknesses less than 50 microns do not provide the desired corrosion resistant properties. As can be seen from FIG. 2, the coating may further be characterized by a microhardness similar to that of the steel matrix. Typical microhardnesses obtained are in the range of from about 160 Vickers (Hv) to about 220 Vickers.

Figure 3:
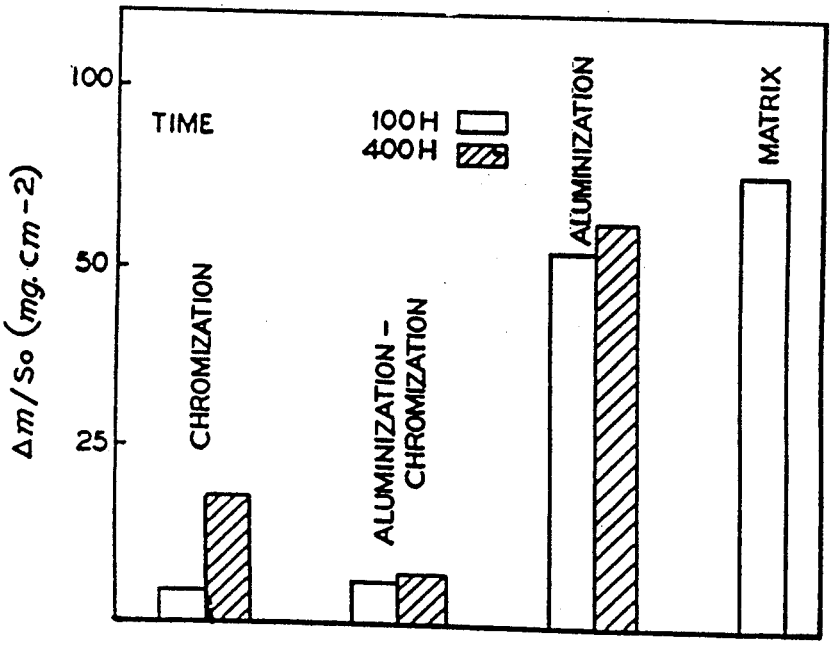
FIG. 3 is a graph illustrating the weight loss for various coated and uncoated lower carbon steels containing chromium and molybdenum when subjected to high temperature corrosion conditions.

It has been found that the double treatment of the present invention produces a synergetic effect which cannot be achieved by applying the individual treatments. FIG. 3 shows the corrosion weight loss of a 9% chromium—2% molybdenum—0.08% carbon steel without any treatment, with each individual treatment, and with the double treatment of the present invention when subjected to a molten salt containing 85 wt.% $V_2O_5$ and 15 wt.% $Na_2SO_4$ in the presence of an atmosphere consisting of 2400 ppm $SO_2$, 1% oxygen and the balance nitrogen for 100 and 400 hours. As can be seen from this Figure, the application of only the aluminization treatment does not significantly change the weight loss that one encounters in the case of the uncoated steel. By applying only the chromization treatment, the corrosion resistance is improved but this tends to be reduced as the time increases. By applying the double treatment in accordance with the present invention, the corrosion resistance is significantly increased. It can be seen from a comparison of FIGS. 1 and 3 that the 9% chromium—2% molybdenum—0.08% carbon steel when subjected to the double treatment of the present invention has corrosion resistance properties substantially equivalent to that of 18% chromium—12% nickel chromized steel.

Figure 4:
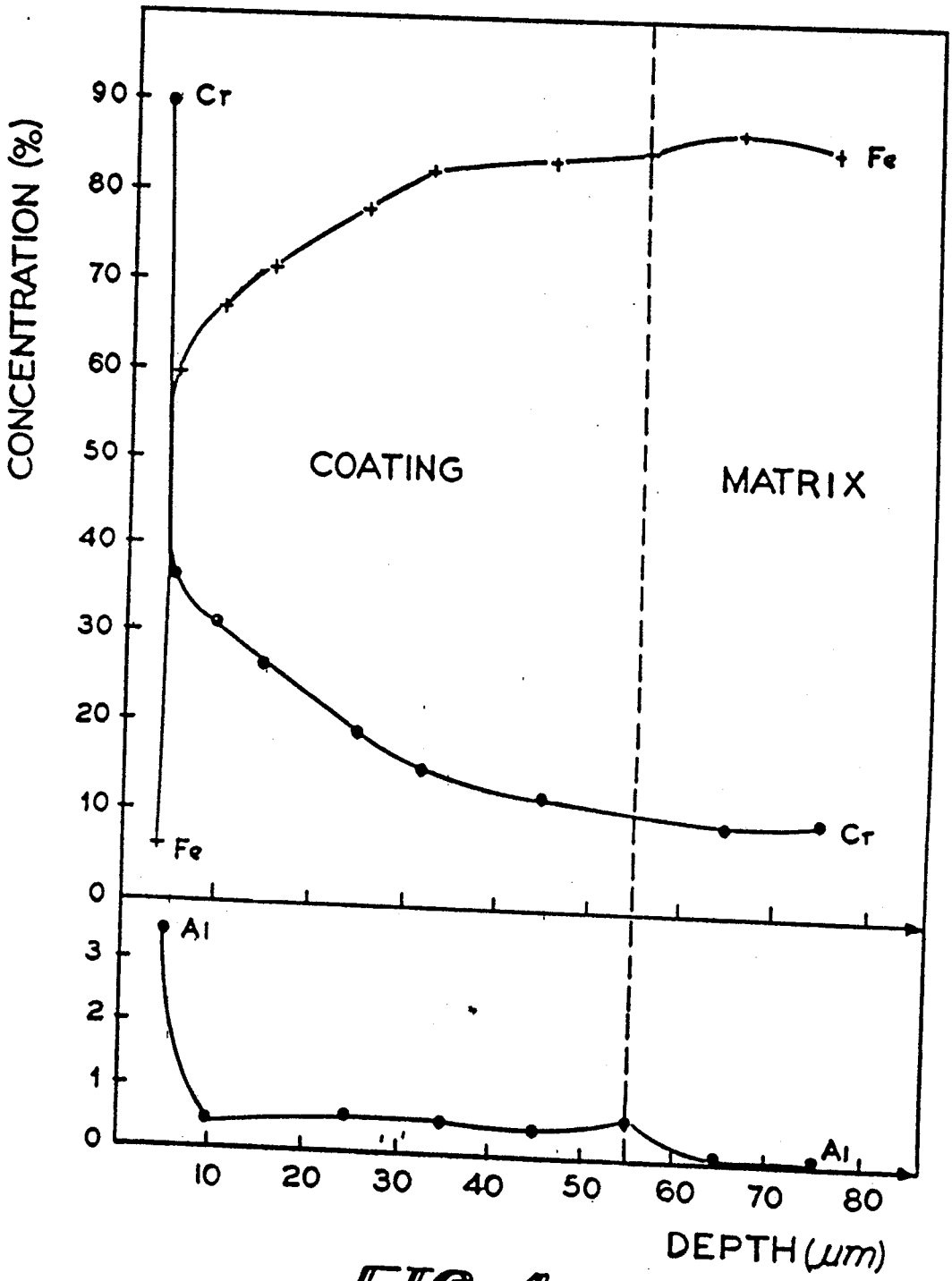
FIG. 4 is a concentration profile of a coating in accordance with the present invention on a 9% chromium—2% molybdenum—0.08% carbon steel.

The presence of aluminum in the corrosion resistant diffusion coating of the present invention provides high chemical resistance in $SO_2/O_2/SO_3$ atmospheres particularly those in the temperature range of 500° C. to 1000° C. The presence of chromium in the coating, especially in high concentration in the external zone, provides high chemical resistance to melt salts containing high vanadium, sulfur, and sodium concentrations. FIG. 4 illustrates the chromium-aluminum concentration profile in the coating. As can be seen from this Figure, a chromium concentration up to 90% chromium is present near the surface within about 10 microns of the surface. This chromium concentration decreases rapidly to approximately 35% chromium at a depth of about 20 microns and continues to decrease to about 12% at the coating - matrix interface. The maximum aluminum concentration in the coating is about 4.5%. This maximum concentration is localized in the vicinity of the external zone within about 10 microns of the surface.

The chromium-aluminum diffusion coating produced by the double treatment of the present invention is further characterized in that the thickness of the coating is substantially uniform. This is particularly desirable from the standpoint of providing substantially uniform corrosion resistance properties. In addition, the coating zone is substantially non-porous and metallurgical microstructure is characterized by a substantially solid solution nature, a single phase, and no abnormal grain growth. In addition, there are substantially no intermetallic compounds, inclusions, carbides or secondary phases, i.e, sigma phase, which can decrease the ductility of the coating.

To demonstrate the advantages of the present invention, the following examples were performed.

EXAMPLE 1

Figure 5:
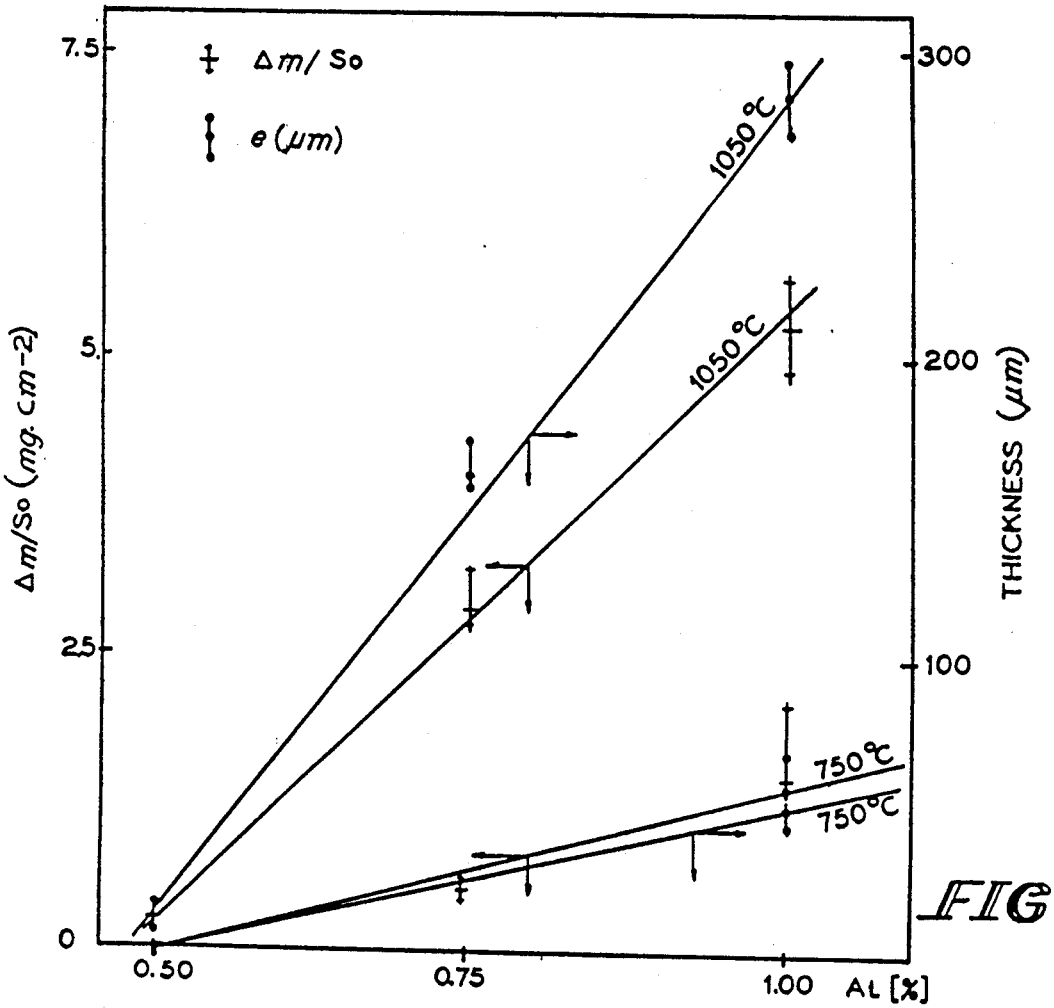
FIG. 5 illustrates weight changes and coating thickness differences as a function of temperature for an aluminization treatment applied to a 9% chromium—2% molybdenum—0.08% carbon steel.

Flat samples (2×1×0.2 mm) of a steel alloy having a nominal composition in weight percentage of 0.08% carbon, 0.32% silicon, 0.54% manganese, 0.022% phosphorous, 0.003% sulfur, 9.27% chromium, 2.07% molybdenum and the balance iron were placed in contact with a powder mixture containing 0.75 wt.% of aluminum, 3 wt.% ammonium chloride and the balance essentially alumina in a high porosity iron box previously treated with the powder. The flat steel samples were then aluminum diffused under reduction conditions at temperatures of 750° C. and 1050° C. for three hours The concentration profile revealed the existence of up to 4.5 wt.% aluminum in the diffusion coating. There were no changes in the microstructure or the mechanical properties of the base metal matrix. FIG. 5 illustrates the weight gain and thickness changes during this treatment for each of the temperatures as a function of the percentage of aluminum in the powder mixture used during the aluminization treatment. FIG. 5 also illustrates the weight gain and thickness changes for treatments using powder mixtures containing 0.5% and 1% aluminum.

Figure 6:
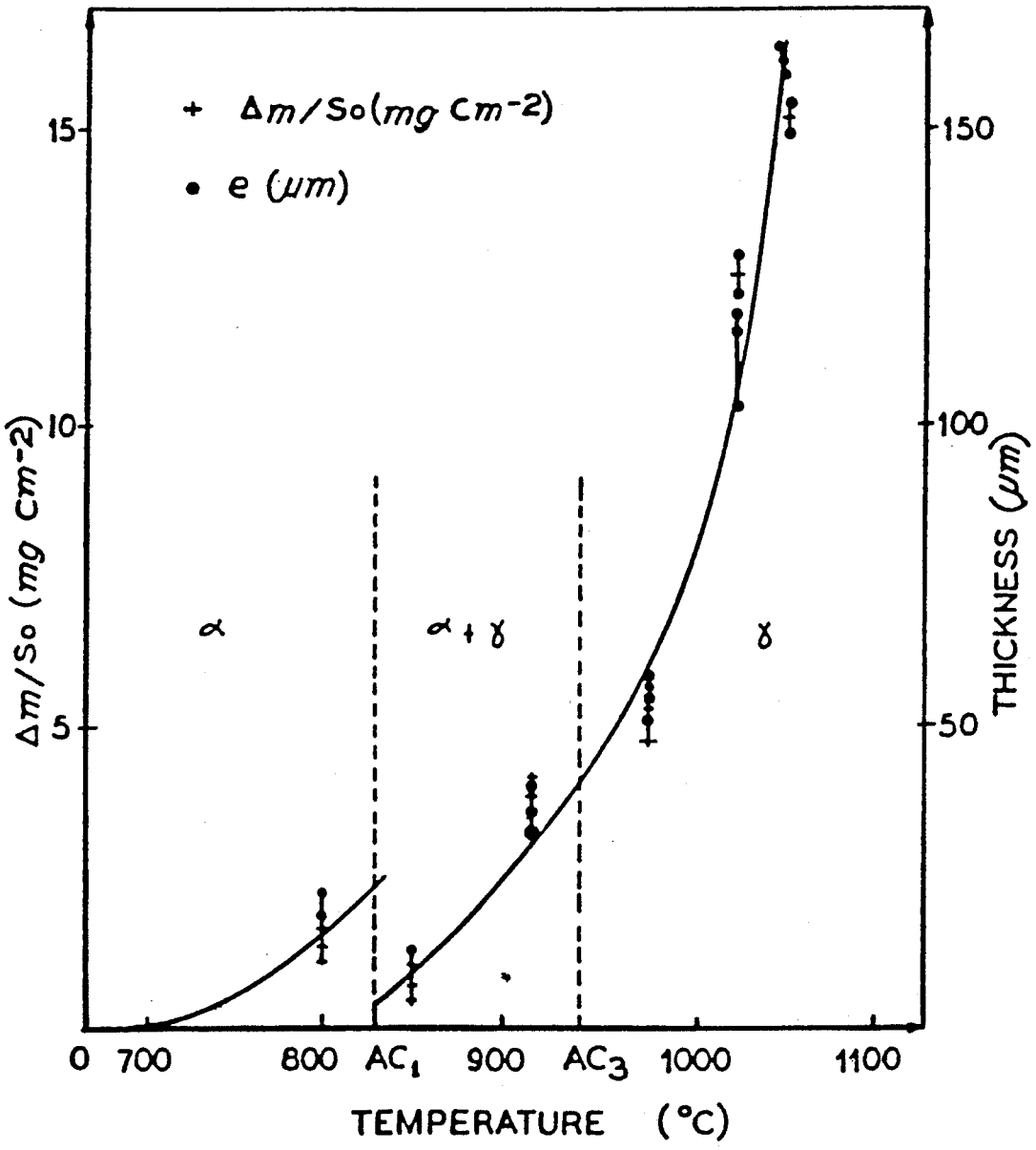
FIG. 6 is a graph illustrating the changes in weight and coating thickness on a 9% chromium—2% molybdenum—0.08% carbon steel subjected to a chromization treatment using a 65% chromium powdered mixture.

The second treatment was performed using a powder mixture containing approximately 65 wt.% chromium, 3 wt.% ammonium chloride, and the balance alumina. This treatment was applied using temperature ranging from 700° C. to 1050° C. FIG. 6 illustrates the changes in weight and thickness of the coating as a function of temperature. The discontinuity observed at point $AC_1$ is believed to be the result of the change in microstructure from an alpha phase to an alpha-gamma phase. The second heat treatment was performed for six hours. The analysis of the coating revealed the existence of a substantially uniform coating, free of porosity and approximately 100 microns thick. The concentration of chromium in the first 10 microns reached as high as 90% while the aluminum concentration reached as high as 4.5%. Hereagain, there was no change in the microstructure or the mechanical properties of the base metal.

EXAMPLE 2

Figure 7:
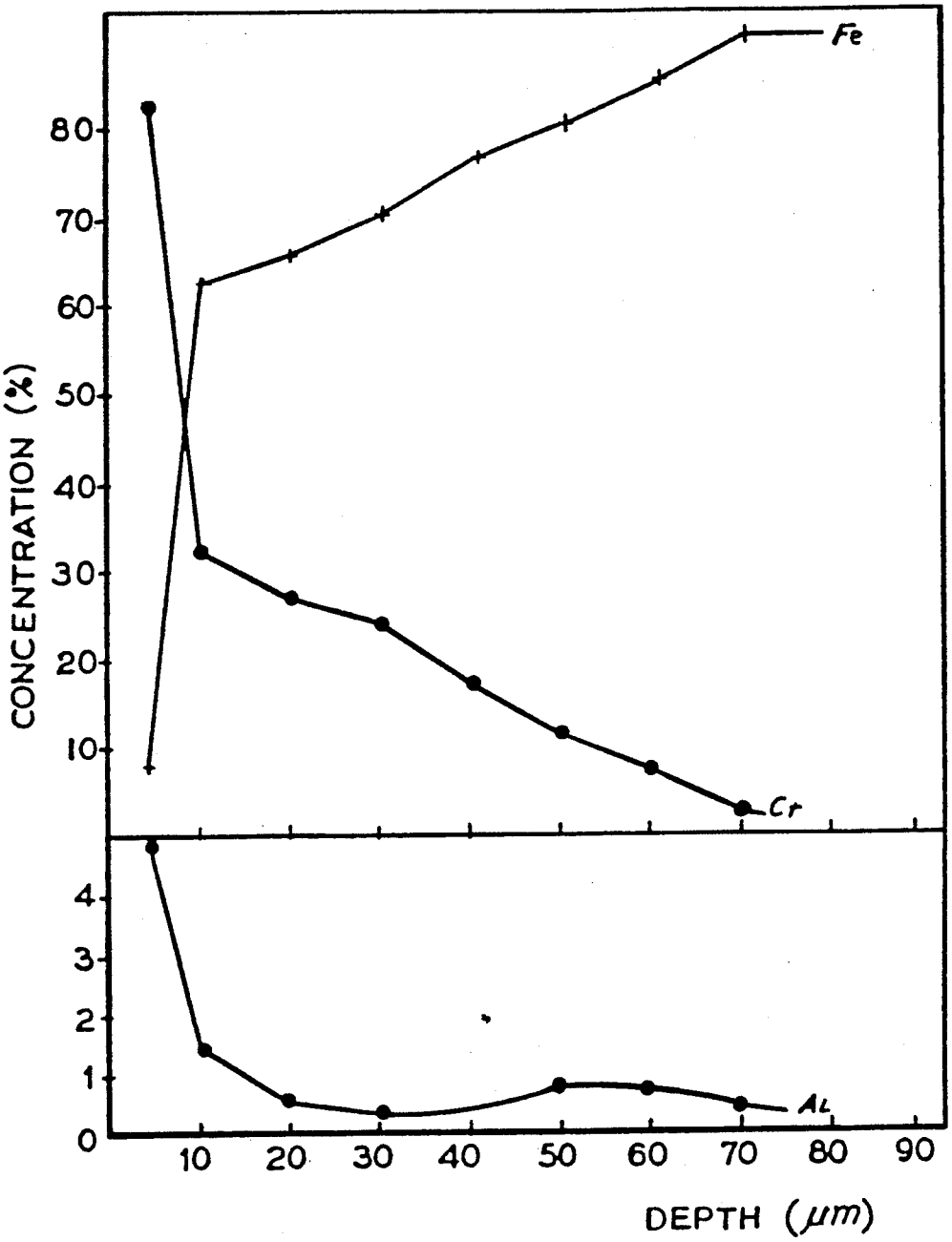
FIG. 7 is a graph illustrating the concentration profile of a chromium-aluminum metallic coating applied to a 2¼% chromium—1% molybdenum—0.1% carbon steel.

Flat samples having the same dimensions as those in Example 1 of a steel with less chromium and higher carbon contents were prepared. The steel had a nominal composition in weight percentage of 0.12% carbon, 0.22% silicon, 0.54% manganese, 2.2% chromium, 0.87% molybdenum, 0.009% sulfur and the balance essentially iron. The samples were then subjected to the same double treatment described in Example 1. The analysis of the aluminum and chromium distribution and the diffusion coating revealed similar results to those obtained in Example 1. FIG. 7 illustrates the concentration profile of the chromium-aluminum diffusion coating. It can be seen from this Figure that within the first 10 microns of the coating, the chromium concentration was greater than 80% and the aluminum concentration was greater than 4%.

EXAMPLE 3

Steel samples prepared, from the alloy described in Example 1 and without any protective coating were introduced into a mixture of 85 wt % $V_2O_5$ and 15 wt.% $Na_2SO_4$ in alumina crucibles. The crucibles were placed in a quartz reactor which was then heated to 700° C. under a gaseous atmosphere of 2400 ppm $SO_2$—100 ppm $SO_3$—1% $O_2$—balance $N_2$. The 100 ppm $SO_3$ was produced by a catalytic partial conversion into $SO_3$ of the $SO_2$ constituent of an initial 2400 ppm $SO_2$—1-%—$O_2$—balance $N_2$ gaseous atmosphere. This conversion was carried out on platinum at 950° C.

The corrosion kinetics were studied for up to 400 hours. During this period the weight loss of the material was recorded. The samples tested were descaled electrolytically (60% $Na_2CO_3$—40% NaOH at 650° C.) and weighed to obtain the metal weight loss due to corrosion. The steel alloy of Example 1 was used as a base metal. It showed a weight loss of 80 mg/cm$^2$ after a total exposure time of 100 hours. Samples of aluminized steel, chromized steel and the steel alloy of Example 1 subjected to the double treatment of the present invention were also tested. The aluminized steel samples for the same total exposure time, registered a weight loss of 60 mg/cm$^2$. Meanwhile for the chromized steel and the double treated steel only a 5 mg/cm$^2$ weight loss was registered.

The measured data for the same samples under the same high temperature corrosive environment but for longer exposure times showed a weight loss of 60 mg/cm$^2$ for aluminized steel, 20 mg/cm$^2$ for chromized steel and 5 mg/cm$^2$ for the steel subjected to the treatment of the present invention.

As can be seen from the foregoing, the successive application of both treatments has a synergetic effect that considerably increases the resistance of the base metal to corrosion by molten salts of vanadium, sulfur and sodium.

EXAMPLE 4

To test the corrosion in molten vanadium salts of successively aluminized and chromized 2¼% chromium—1% molybdenum—0.12% carbon steel, the following example was performed. Test samples of this alloy without any coating were exposed to a salt mixture of 85 wt.% $V_2O_5$ and 15 wt.% $Na_2SO_4$ in the same atmosphere used in Example 3 at a temperature of 700° C. Samples of the same alloy after successive aluminization and chromization treatments were also tested under the same conditions. The corrosion kinetics were studied for about 100 hours. A weight loss of 150 mg/cm$^2$ was recorded for the uncoated steel alloy. Meanwhile, for the aluminized and chromized alloy, the weight loss was only 90 mg/cm$^2$. The aluminization and chromatization treatments were carried out as in Example 1.

EXAMPLE 5

Boiler tubes of 9% chromium—2% molybdenum—0.08% carbon steel having a 1¼ inch diameter were coated using the aluminization and chromization treatments of Example 1. The weight gain per unit of surface during the treatments and the thickness and other characteristics of the metallic coating applied to the boiler tubes were similar to the results obtained in Example 1. The metallic coating in this sample was applied to both the external and internal surfaces of the tube. The cementation techniques of the present invention permit the application of coatings on multiple surfaces of articles having a complex geometry and/or regions difficult to access.

EXAMPLE 6

A corrosion test was also carried out in a pilot plant which burns heavy oil characterized by the presence of 50 ppm vanadium, 4 wt.% sulfur and 87 ppm sodium. A MgO additive was added to the oil to reduce the corrosion aggresivity of the oil. The tests were carried out using a steel alloy containing 2¼% chromium—1% molybdenum and 0.12% carbon in a coated state. The coated steel had a diffusion coating formed in accordance with the present invention. The tests were also conducted using tubes formed from 12% chromium steel, from a 55% nickel alloy, and uncoated 9% chromium —2% molybdenum—0.08% carbon steel.

The test lasted 400 hours and the external temperatures of the tubes was approximately 450 to 500° C. The corrosion weight loss registered for the steel treated in accordance with the present invention was 0.70 $mg/m^2h$. Other results showed weight losses of 1.4 $mg/m^2h$ for the uncoated steel, 0.44 $mg/m^2h$ for the 12% chromium steel and 2.89 $mg/m^2h$ for the 55% nickel alloy.

EXAMPLE 7

A corrosion test was conducted on coated 9% chromium—2% molybdenum—0.08% carbon steel tubes in boilers burning rich vanadium, sulfur and sodium residual oil. These boilers were in electric plants or refineries burning the residual combustible. The residual combustible was characterized by the presence of 346 ppm vanadium and 2.5 wt.% sulfur. The tubes were installed in the superheater section of the boiler and were exposed to an external temperature of approximately 800° C.

The boiler test was continuously run for a total time of 10,000 hours. The results showed high resistance to corrosion of the tubes coated by the aluminization and chromization process of the present invention including welded zones. Visual inspection showed better corrosion resistance for the coated tubes as compared to uncoated tubes of the same steel and those of tubes formed from other steels and alloys.

As can be seen from the foregoing description, the coating provided by the process of the present invention greatly improves the corrosion resistance of steel components exposed to corrosive environments containing high concentrations of vanadium, sodium and sulfur. As a result, low carbon steel components provided with the coating of the present invention are particularly well suited for use as boiler and furnace components.

As used herein, the percentages of the alloy compositions and the atmospheres and environments are weight percentages.

While the coatings of the present invention have been described in connection with particular low carbon steel alloys, it should be recognized that the same or similar corrosion resistant diffusion coating can be applied to other low carbon steel and iron alloys.

It is apparent that there has been provided in accordance with this invention, a technique for improving the corrosion resistance of low carbon steels in a vanadium, sulfur and sodium environment at high temperatures which fully satisfies the objects, means, and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An article of manufacture which is resistant to corrosive attack at high temperatures in environments having concentrations of vanadium, sulfur and sodium comprising an iron alloy containing less than about 0.25% carbon having a diffusion coating containing aluminum and chromium on at least one surface thereof, said diffusion coating having a thickness in a range of between about 50 microns to 200 microns wherein the concentration of chromium at a depth of about 20 microns is approximately 35% chromium and the concentration of chromium increases at depths of less than 20 microns wherein the concentration of chromium adjacent an external surface of said coating is up to about 90% and the maximum concentration of aluminum in said coating is about 4.5%.

2. An article according to claim 1 wherein the maximum concentration of aluminum is localized within about 10 microns of an external surface of said coating.

3. An article according to claim 1 wherein said coating has a micro-hardness in the range of from about 160Hv to about 220Hv.

4. An article according to claim 1 wherein said alloy is a low carbon steel alloy having a carbon content of less than about 0.15% carbon.

5. An article according to claim 1 wherein said alloy consists essentially of from about 2.25% to about 18% chromium, up to about 12% nickel, from about 0.5% to about 2.0% molybdenum, less than about 0.25% carbon and the balance essentially iron.

6. An article according to claim 1 wherein said article comprises a boiler tube.

7. An article according to claim 1 wherein said article comprises a furnace component.

8. An article according to claim 1 wherein said coating is substantially non-porous, has a substantially uniform thickness, and has a substantially single phase, solid solution metallurgical microstructure.

* * * * *